US011827857B2

(12) United States Patent
Narayanaswamy et al.

(10) Patent No.: US 11,827,857 B2
(45) Date of Patent: Nov. 28, 2023

(54) CONVERSION OF HEAVY ENDS OF CRUDE OIL OR WHOLE CRUDE OIL TO HIGH VALUE CHEMICALS USING A COMBINATION OF THERMAL HYDROPROCESSING, HYDROTREATING WITH STEAM CRACKERS UNDER HIGH SEVERITY CONDITIONS TO MAXIMIZE ETHYLENE, PROPYLENE, BUTENES AND BENZENE

(71) Applicant: SABIC Global Technologies B.V., Bergen Op Zoom (NL)

(72) Inventors: Ravichander Narayanaswamy, Bangalore (IN); Hatem Belfadhel, Riyadh (SA); Girish Koripelly, Bangalore (IN); Alexander Stanislaus, Bangalore (IN); Krishna Kumar Ramamurthy, Bangalore (IN); Krishnan Sankaranarayanan, Sugar Land, TX (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 199 days.

(21) Appl. No.: 17/424,665

(22) PCT Filed: Jan. 27, 2020

(86) PCT No.: PCT/IB2020/050613

§ 371 (c)(1),
(2) Date: Jul. 21, 2021

(87) PCT Pub. No.: WO2020/157631

PCT Pub. Date: Aug. 6, 2020

(65) Prior Publication Data

US 2022/0106532 A1 Apr. 7, 2022

Related U.S. Application Data

(60) Provisional application No. 62/798,409, filed on Jan. 29, 2019.

(51) Int. Cl.
*C10G 67/14* (2006.01)
*C10G 7/00* (2006.01)
(Continued)

(52) U.S. Cl.
CPC ..... *C10G 67/14* (2013.01); *C10G 7/00* (2013.01); *C10G 9/36* (2013.01); *C10G 21/003* (2013.01);
(Continued)

(58) Field of Classification Search
CPC . C10G 67/14; C10G 7/00; C10G 9/36; C10G 21/003; C10G 47/22;
(Continued)

(56) References Cited

U.S. PATENT DOCUMENTS 4,462,895 A 7/1984 Biceroglu et al.
4,557,821 A 12/1985 Lopez et al.
(Continued)

FOREIGN PATENT DOCUMENTS

CN 104560177 4/2015
CN 105473691 4/2016
(Continued)

OTHER PUBLICATIONS

Fathi et al., "Catalytic Aquaprocessing of Arab Light Vacuum Residue via Short Space Times" *Energy Fuels* 2011, 25(11), 4867-4877.
(Continued)

*Primary Examiner* — Randy Boyer
*Assistant Examiner* — Juan C Valencia
(74) *Attorney, Agent, or Firm* — Norton Rose Fulbright US LLP

(57) ABSTRACT

Systems and methods for producing olefins and/or aromatics are disclosed. Methods disclosed includes thermal hydro-processing of crude oils and/or heavy oils and/or residues, in a thermal hydro-processing unit, to produce intermediate products, which can then be used to make valuable chemicals such as olefins and aromatics.

20 Claims, 4 Drawing Sheets

(51) Int. Cl.
*C10G 9/36* (2006.01)
*C10G 21/00* (2006.01)
*C10G 47/22* (2006.01)

(52) U.S. Cl.
CPC ..... *C10G 47/22* (2013.01); *C10G 2300/107* (2013.01); *C10G 2300/1033* (2013.01); *C10G 2300/1077* (2013.01); *C10G 2300/206* (2013.01); *C10G 2300/4012* (2013.01); *C10G 2300/44* (2013.01); *C10G 2300/807* (2013.01); *C10G 2400/20* (2013.01); *C10G 2400/30* (2013.01)

(58) Field of Classification Search
CPC ..... C10G 2300/1033; C10G 2300/107; C10G 2300/1077; C10G 2300/206; C10G 2300/4012; C10G 2300/44; C10G 2300/807; C10G 2400/20; C10G 2400/30; C10G 69/06
See application file for complete search history.

(56) References Cited

U.S. PATENT DOCUMENTS

| | | | | |
|---|---|---|---|---|
| 5,080,777 | A | 1/1992 | Aegerter, Jr. et al. | |
| 5,688,395 | A | 11/1997 | Carrazza et al. | |
| 5,885,441 | A | 3/1999 | Pereira et al. | |
| 6,171,473 | B1 | 1/2001 | Fornoff | |
| 9,115,318 | B2 | 8/2015 | Al-Abdulal et al. | |
| 9,168,506 | B2 | 10/2015 | Canelon et al. | |
| 9,284,501 | B2 | 3/2016 | Sayed et al. | |
| 10,689,587 | B2 | 6/2020 | Al-Sayed et al. | |
| 2007/0090018 | A1* | 4/2007 | Keusenkothen ..... | C10G 45/44 422/600 |
| 2007/0090019 | A1 | 4/2007 | Keusenkothen et al. | |
| 2013/0197285 | A1 | 8/2013 | Shafi et al. | |
| 2013/0248418 | A1 | 9/2013 | Sayed et al. | |
| 2015/0144527 | A1 | 5/2015 | Fathi et al. | |
| 2016/0122668 | A1 | 5/2016 | Sayed et al. | |
| 2016/0137933 | A1 | 5/2016 | Ward et al. | |
| 2017/0015916 | A1 | 1/2017 | Oprins et al. | |
| 2018/0187099 | A1 | 7/2018 | Bourane et al. | |
| 2018/0312767 | A1 | 11/2018 | Al-Sayed et al. | |

FOREIGN PATENT DOCUMENTS

| | | |
|---|---|---|
| CN | 106164224 | 11/2016 |
| CN | 107118801 | 9/2017 |
| CN | 107916128 | 4/2018 |
| CN | 113710776 | 11/2021 |
| EP | 3110913 | 1/2017 |
| EP | 3110914 | 1/2017 |
| WO | WO 2013126364 | 8/2013 |
| WO | WO 2015/128043 | 9/2015 |
| WO | WO 2015/128044 | 9/2015 |
| WO | WO 2018/142351 | 8/2018 |

OTHER PUBLICATIONS

Fathi et al., "Kinetic Modeling of Arab Light Vacuum Residue Upgrading by Aquaprocessing at High Space Velocities" *Ind. Eng. Chem. Res.* 2013, 52(2), 612-623.

Fathi, M. M., *Comparative upgrading of arab light vacuum residuum via aquaprocessing and thermal cracking* (Unpublished doctoral thesis). 2011. University of Calgary, Calgary, AB. doi:10.11575/PRISM/4384.

Garcia-Hubner, Eduardo Antonio, *Catalysts Evaluation for Catalytic Steam Cracking of De-asphalted Oil in a Fixed Bed Reactor*. 2015. University of Calgary, Thesis.

International Search Report and Written Opinion issued in Corresponding PCT Application No. PCT/IB2020/050613.

Joshi et al., "Petroleum Residue Upgradation via Visbreaking: A Review" *Ind. Eng. Chem. Res.* 2008, 47(23), 8960-8988.

Office Action issued in Corresponding GCC Application No. GC 2020-39086, dated Jul. 30, 2021.

Corma et al. "Crude oil to chemicals: light olefins from crude oil." Catalysis Science and Technology, vol. 7 (2017), 86 pages.

Corma, et al. "Direct crude oil cracking for producing chemicals: Thermal cracking modeling." Fuel, vol. 211 (2018) 726-736.

* cited by examiner

CONVERSION OF HEAVY ENDS OF CRUDE OIL OR WHOLE CRUDE OIL TO HIGH VALUE CHEMICALS USING A COMBINATION OF THERMAL HYDROPROCESSING, HYDROTREATING WITH STEAM CRACKERS UNDER HIGH SEVERITY CONDITIONS TO MAXIMIZE ETHYLENE, PROPYLENE, BUTENES AND BENZENE

CROSS REFERENCE TO RELATED APPLICATIONS

This application is a national phase under 35 U.S.C. § 371 of International Application No. PCT/IB2020/050613, filed Jan. 27, 2020, which claims priority to and the benefit of U.S. Provisional Application No. 62/798,409, filed Jan. 29, 2019, the contents of each of which are incorporated into the present application in their entirety.

FIELD OF INVENTION

The present invention generally relates to the refining of crude oil and/or heavy oil, and/or residues. More specifically, the present invention relates to the thermal hydroprocessing of crude oils and/or heavy oils and/or residues to produce intermediate products, which can then be used to make valuable chemicals such as olefins and aromatics.

BACKGROUND OF THE INVENTION

The conversion of whole petroleum crude oil to chemicals practiced in the art includes the use of a series of hydrocrackers, fluid catalytic crackers (FCCs) and steam crackers to produce either high value chemicals only or a combination of high value chemicals and fuels. However, hydrocracking, fluid catalytic cracking, and steam cracking processes involve problematic upgrading of heavy ends of crude oils using multi-step processes such as resid hydrocracking, coking, middle distillate hydrocracking, naphtha range hydrocracking etc., before actually feeding hydrocarbons to final conversion units like steam crackers or FCCs to produce olefins and/or aromatics. Furthermore, the hydroprocessing conditions employed involve high pressures, up to 200 barg, which require high investment costs in equipment. Because the upgrading involves using multiple feed preparation units, e.g., hydrocrackers, cokers, and hydrotreaters, at each stage, not only is there a forced cracking of molecules and addition of $H_2$ for satisfying the hydrogen deficiency introduced as a result of cracking at each stage, there is also a preheating of the feed to operating temperatures by feed preheat furnaces for each of these feed preparation units. This results in the consumption of large amounts of fuel on the utility side as well. Hence, there is a need for feed upgradation and conversion to chemicals using a more intensified process that employs a minimum number of processing units and employs processes that convert the crude oil in an optimal manner to feeds for downstream conversion units. The downstream conversion units convert the feeds to high value chemicals; and it is desirable that this is done with a preference for maximizing ethylene while producing propylene and benzene.

BRIEF SUMMARY OF THE INVENTION

A discovery has been made that provides a solution to at least some of the problems associated with processing crude oils and/or heavy oils and/or residues. The solution is premised on a sophisticated process that uses hydrogen and water and/or steam to efficiently upgrade crude oils and/or heavy oils and/or residues. The upgraded products are then fed to conversion units that convert these upgraded products to olefins and aromatics such as ethylene, propylene, butene, and benzene.

Embodiments of the invention include a method of processing hydrocarbons. The method includes subjecting a mixture comprising (1) a feedstock of crude oil and/or heavy oil and/or residues, (2) water and/or steam, (3) hydrogen, (4) a solvent selective for dissolving asphaltene, in a processing unit, to conditions sufficient to convert at least some hydrocarbon molecules of the feedstock to molecules that have less carbon atoms than the at least some hydrocarbon molecules. The method further includes recovering, from the processing unit, intermediate product streams comprising: (1) a gas stream that comprises primarily $C_1$ to $C_4$ hydrocarbons, (2) a liquid stream that comprises primarily saturates. Further yet, the method includes cracking the liquid stream to produce one or more of ethylene, propylene, butene, and benzene.

Embodiments of the invention include a method of processing hydrocarbons. The method includes flowing (1) a feedstock of crude oil and/or heavy oil and/or residues, (2) water and/or steam, (3) hydrogen, (4) a solvent selective for dissolving asphaltene to a processing unit, the processing unit comprising (a) a reactor unit that comprises a plurality of reactors and (b) a separation unit comprising a distillation column. The method further includes subjecting a mixture comprising the feedstock of crude oil and/or heavy oil and/or residues, the water and/or steam, a first portion of the hydrogen, and a first portion of the solvent in a first reactor of the plurality of reactors, to reaction conditions sufficient to convert at least some hydrocarbon molecules of the feedstock to molecules that have less carbon atoms than the at least some hydrocarbon molecules of the feedstock. In embodiments of the method, no catalyst is provided for converting of the at least some hydrocarbon molecules and the solvent is provided in the mixture in a quantity sufficient to keep at least 90 wt. % of asphaltenes from the feedstock in solution so that asphaltenes do not crash out during the course of conversion. The method also includes flowing first reactor effluent from the first reactor to a second reactor of the plurality of reactors and subjecting the first reactor effluent, a second portion of the hydrogen, and a second portion of the solvent, in the second reactor of the plurality of reactors, to reaction conditions sufficient to convert at least some hydrocarbon molecules of the first reactor effluent to molecules that have less carbon atoms than the at least some hydrocarbon molecules of the first reactor effluent. The construct of the plurality of reactors can in fact be a single large reactor (say a tubular reactor, bubble column reactor, jet loop reactors or other types) with staged injection of solvent and hydrogen along its length. The method further includes flowing reactor unit effluent from the reactor unit to the separation unit and distilling, in the distillation column, the reactor unit effluent, to produce streams comprising: (1) a gas stream that comprises primarily $C_1$ to $C_4$ saturates, (2) a liquid product stream that comprises primarily saturates. The method may also include removing coke from the reactor unit. The method further includes cracking, in a steam cracker, the liquid product stream to produce one or more of ethylene, propylene, butene, and benzene.

The following includes definitions of various terms and phrases used throughout this specification.

The term "crude oil," as that term is used in the specification and/or claims, means oil from underground that has not been processed to make products such as gasoline, naphtha, kerosene, gasoil, and residue. Crude oil can have a gravity of 4 to 80° API, more typically 15 to 45° API.

The term "heavy oil," as that term is used in the specification and/or claims, means a portion of crude oil that boils above 350° C., which could be generated as bottoms of crude oil atmospheric tower or a vacuum gas oil portion of the crude oil that boils from 350° C. to 550° C. generated in a crude oil vacuum tower or vacuum residue portion that boils above 550° C. generated as a bottoms of crude oil vacuum tower.

The term "residual" (or "resid") as that term is used in the specification and/or claims, means a mixture of petroleum compounds including aromatics, paraffins, sulfur, nitrogen metals that is generated from whole crude oil by removing materials boiling below a certain boiling point. For example, a 120+° C. residue is generated as a bottoms when whole crude oil is distilled to remove hydrocarbons boiling below 120° C.

The term "saturates" refers to hydrocarbons of the type paraffins, isoparaffins, and naphthenes alone or in any combination.

The term "resin" refers to hydrocarbon with more than 3 to 4 aromatic rings with and without side chains and with or without naphthenic species.

The term "asphaltenes" refers to molecules with island and archipelago structures and also molecules with polycyclic rings with and without heteroatoms.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refer to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, includes any measurable decrease or complete inhibition to achieve a desired result.

The term "effective," as that term is used in the specification and/or claims, means adequate to accomplish a desired, expected, or intended result.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

The term "primarily," as that term is used in the specification and/or claims, means greater than any of 50 wt. %, 50 mol. %, and 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which.

DETAILED DESCRIPTION OF THE INVENTION

A method has been discovered for upgrading whole crude oils, and/or heavy oils and/or residues, which involves using hydrogen and water and/or steam in a thermal hydro-processing unit. The upgraded products are then converted to olefins such as ethylene, propylene, and butene and aromatics such as benzene.

Figure 1:
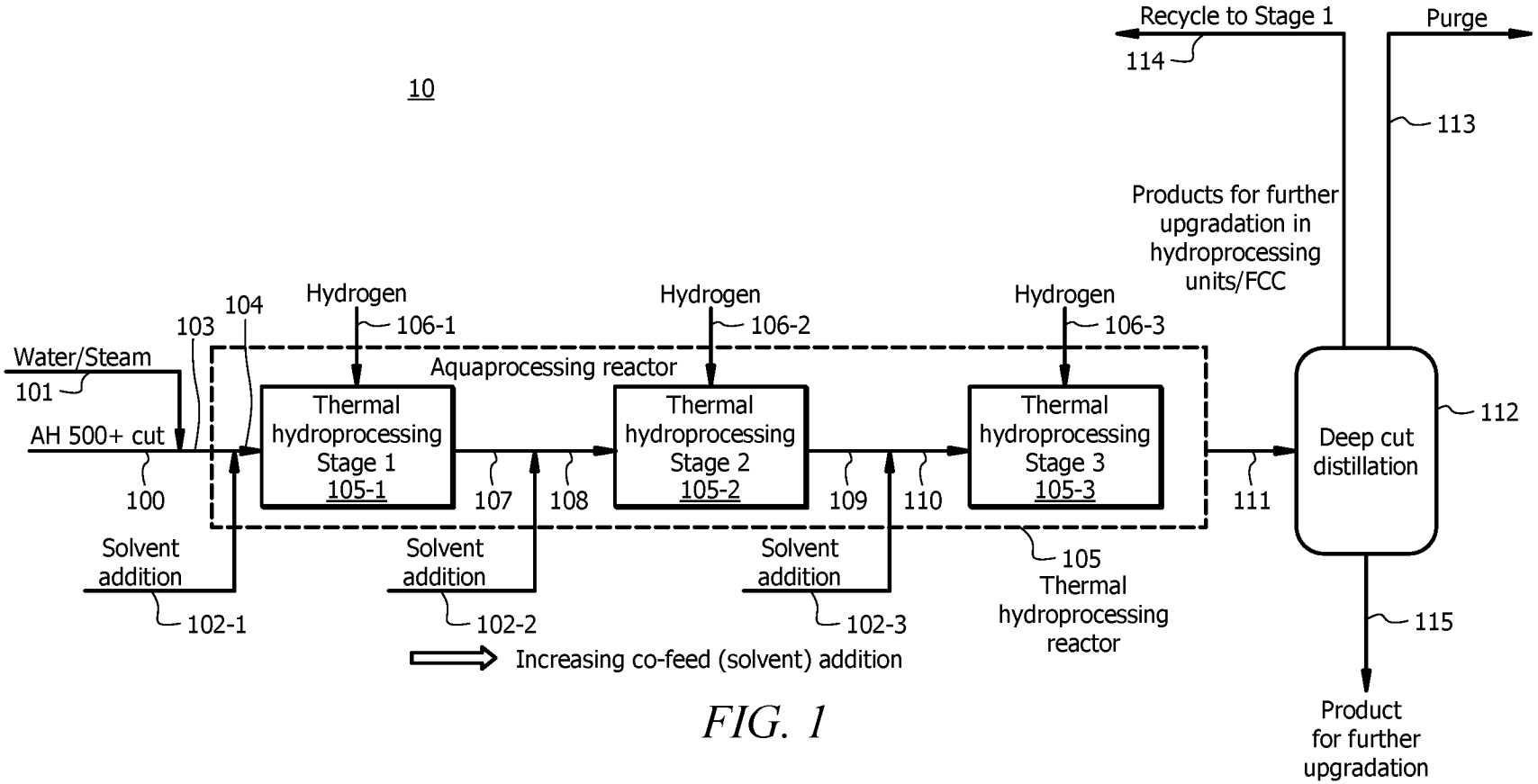
FIG. 1 is a system for thermal hydro-processing crude oil and/or heavy oil, according to embodiments of the invention.
Figure 2:
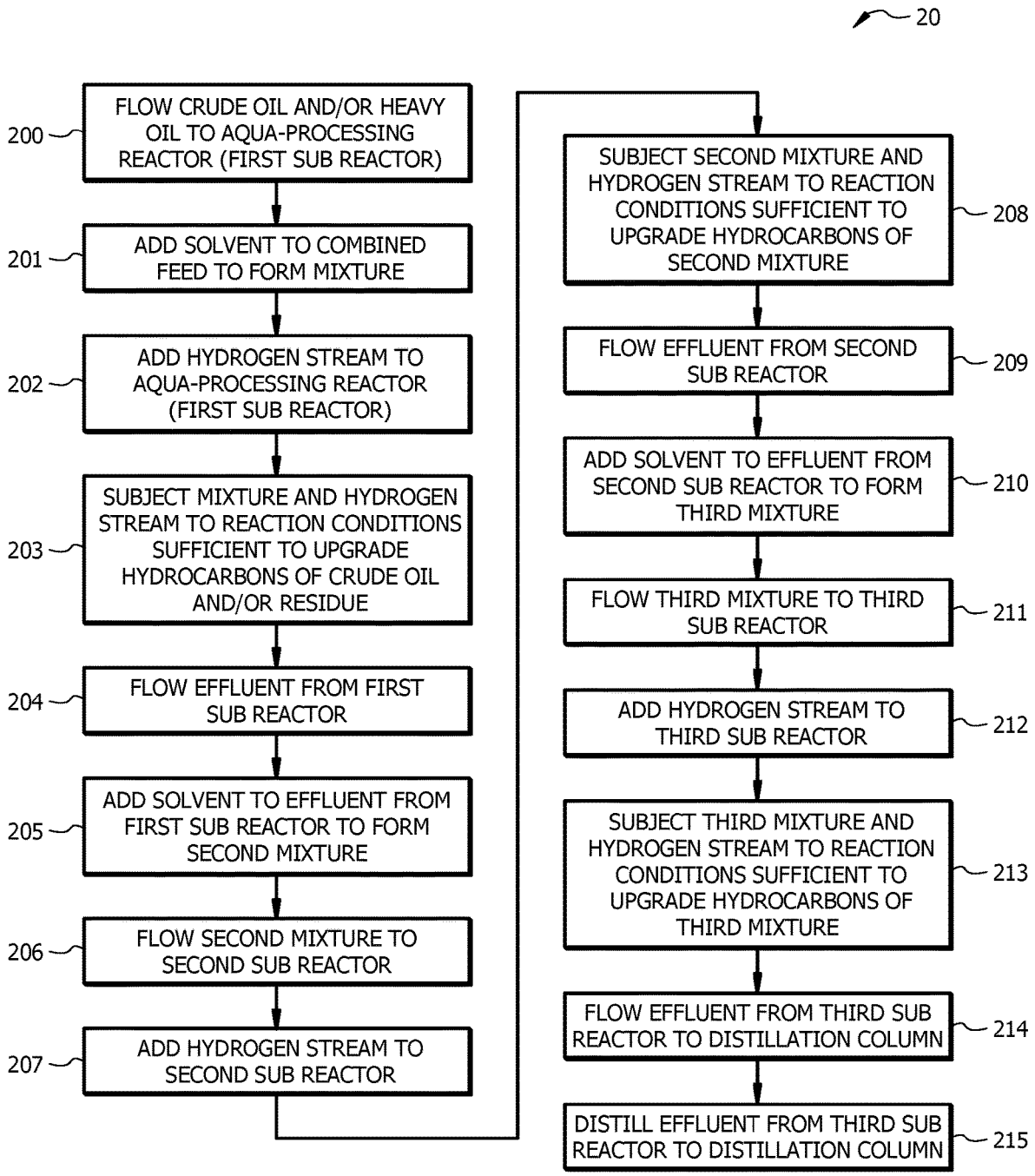
FIG. 2 is a method for thermal hydro-processing crude oil and/or heavy oil and/or residues, according to embodiments of the invention.

FIG. 1 shows system 10 for thermal hydro-processing crude oil and/or heavy oil and/or residues, according to embodiments of the invention. FIG. 2 shows method 20 for thermal hydro-processing crude oil and/or heavy oil and/or residues, according to embodiments of the invention. Method 20 may be implemented using system 10.

Table A shows the properties of AH 500+ cut and AL 500+ cut shown in FIG. 1. It should be noted that embodiments of the invention can include values for the properties that are in a range within 10% of the values shown in Table A.

TABLE A

| Properties | AL 505+° C. Cut | AH 505+° C. Cut |
|---|---|---|
| API Gravity | 9.5 | 5.5 |
| Density (g/cc) | 1.0024 | 1.0223 |
| K factor | 11.64 | 11.56 |
| Total Sulphur, Wt. % | 4.09 | 5.32 |
| Total Nitrogen, ppm | 2209 | 2861 |
| Conradson Carbon Residue, Wt. % | 17.2 | 21.91 |
| Asphaltenes, Wt. % | 6.39 | 14.69 |

According to embodiments of the invention, method 20 involves, at block 200, flowing feed 100 (crude oil and/or heavy oil and/or residues) to thermal hydro-processing reactor 105. In embodiments of the invention, feed 100 comprises AH 500+° C. According to embodiments of the invention, AH 500+° C. cut has the following properties: 5.0 to 6.0 API gravity, 0.92007 to 1.12453 density (g/cc), 10.404 to 12.716 K factor, 4.788 to 5.852 wt. % total sulphur, 2574.9 to 3147.1 ppm total nitrogen, 19.72 to 24.10 wt. % Conradson carbon residue, 13.22 to 16.16 wt. % asphaltenes. Block 200 in embodiments of the invention, include combining feed 100 with $H_2O$ stream 101 (water and/or steam) to form combined feed 103. According to embodiments of the invention, $H_2O$ is provided at a flow rate required to supply at least more than 0.2 wt. % hydrogen with respect to feed 100. In embodiments of the invention, $H_2O$ stream 101 is at a temperature of 25 to 300° C.

According to embodiments of the invention, combined feed 103 may be at a temperature, entering thermal hydro-processing reactor 105, in a range of 25 to 500° C. As an alternative to or in addition to mixing feed 100 and $H_2O$ stream 101 to form combined feed 103 outside of thermal hydro-processing reactor 105, in embodiments of the invention, feed 100 may be combined with $H_2O$ stream 101, within thermal hydro-processing reactor 105 (which can be one reactor or can comprise a plurality of sub reactors).

According to embodiments of the invention, thermal hydro-processing reactor 105 comprises a plurality of sub reactors that implement a plurality of stages in thermal hydro-processing reactor 105. As shown in FIG. 1, thermal hydro-processing reactor 105 may comprise sub reactor 105-1, sub reactor 105-2, and sub reactor 105-3, where each sub-reactor implements a thermal hydro-processing stage in thermal hydro-processing reactor 105.

According to embodiments of the invention, at block 201, solvent 102-1 is added to combined feed 103 to form mixture 104, which is fed to thermal hydro-processing reactor 105 (specifically sub reactor 105-1). Alternatively or additionally, in embodiments of the invention, combined feed 103, or components thereof, may be combined with solvent 102-1 within thermal hydro-processing reactor 105 (specifically sub reactor 105-1). According to embodiments of the invention, solvent 102-1 is used to dissolve and keep asphaltenes in solution. In embodiments of the invention, solvent 102-1 comprises primarily aromatics and/or resin. In embodiments of the invention, solvent 102-1 comprises crude oil, Arab Light, Arab Heavy, or combinations thereof. Other solvents, for use in embodiments of the invention, could be swelling solvents like acetone, acetonitrile, methanol, ethyl acetate, hydrocarbon solvents such as hexane, heptane, iso-octane, electron donor solvents (organic bases) such as pyridine, tetrahydrofuran, amines, and combinations thereof. It should be noted that the addition of solvent 102-1 to combined feed 103 and/or to the mixture in sub reactor 105-1 prevents asphaltenes from crashing out of solution (precipitating) during the operation.

At block 202, in embodiments of the invention, hydrogen stream 106-1 is added to sub reactor 105-1. In embodiments of the invention, hydrogen stream 106-1 comprises a pure hydrogen gas from steam methane reformer or a hydrogen grid or a hydrogen rich stream such as fuel gas. Fuel gas can comprise $H_2$, $C_1$, $C_2$ and to some extent $C_3$. In embodiments of the invention, it is preferable to have hydrogen stream 106-1 comprising greater than 50 wt. % $H_2$. According to embodiments of the invention, hydrogen stream 106-1 may be at a temperature, entering thermal hydro-processing reactor 105, in a range of 25 to 500° C.

According to embodiments of the invention, at block 203, a mixture of mixture 104 and hydrogen stream 106-1 is subjected to reaction conditions in sub reactor 105-1 sufficient to upgrade feed 100. In this way, hydrocarbon molecules of feed 100 are converted into smaller molecules. According to embodiments of the invention, the upgrading process can be carried out in sub reactor 105-1 at a temperature in a range of 400 to 550° C., preferably in a range of 450 to 470° C.; at a pressure of up to 200 barg, preferably a pressure of 100 barg or less. Here, the process involves treating the whole crude oil or heavy oil with water and/or steam, co-feed (solvent) under pressure of hydrogen, which converts the whole crude oil or heavy oil into lighter compounds such as distillates. Including hydrogen in thermal hydro-processing reactor 105 (specifically sub reactor 105-2) as disclosed herein also has the effect of reducing coke formation and results in higher carbon efficiency. According to embodiments of the invention, the inclusion of water/steam in the reactor can have the benefit of reducing coke formation.

At block 204, according to embodiment of the invention, effluent 107 is flowed from sub reactor 105-1. According to embodiments of the invention, conversion of 350+° C. material present in the feed (mixture) to each of sub reactor 105-1, sub reactor 105-2, sub reactor 105-3 is converted to 350-° C. material up to an extent of 100%, alternatively 90%, 80%, 70% and not less than 60%. This conversion can be achieved by sub reactor 105-1, sub reactor 105-2, sub reactor 105-3.

In embodiments of the invention, method 20 involves, at block 205, adding solvent 102-2 to effluent 107 to form mixture 108, which is fed to sub reactor 105-2, at block 206.

According to embodiments of the invention, method 20, at block 207, includes hydrogen stream 106-2 being added to sub reactor 105-2. In embodiments of the invention, hydrogen stream 106-2 has a similar or same composition as hydrogen stream 106-1. According to embodiments of the invention, hydrogen stream 106-2 may be at a temperature, entering sub reactor 105-2, in a range of 25 to 500° C.

According to embodiments of the invention, at block 208, a mixture of mixture 108 and hydrogen stream 106-2 is subjected to reaction conditions in sub reactor 105-2 sufficient to convert hydrocarbon molecules of mixture 108 into smaller molecules (further upgrade of feed 100). According to embodiments of the invention, the further upgrading can be carried out in sub reactor 105-2 at a temperature in a range of 400 to 550° C., preferably in a range of 450 to 470° C. and at a pressure of up to 200 barg, preferably a pressure of 100 barg or less.

At block 209, according to embodiment of the invention, effluent 109 is flowed from sub reactor 105-2. According to embodiments of the invention, conversion of 350+° C. material present in the feed (mixture) to each of sub reactor 105-1, sub reactor 105-2, sub reactor 105-3 is converted to 350-° C. material up to an extent of 100%, alternatively 90%, 80%, 70% and not less than 60%. This conversion can be achieved by sub reactor 105-1, sub reactor 105-2, sub reactor 105-3.

In embodiments of the invention, method 20 involves, at block 210, adding solvent 102-3 to effluent 109 to form mixture 110, which is fed to sub reactor 105-3, at block 211.

According to embodiments of the invention, method 20, at block 212, includes hydrogen stream 106-3 being added to sub reactor 105-3. In embodiments of the invention, hydrogen stream 106-3 has a similar or same composition as hydrogen stream 106-1. According to embodiments of the invention, hydrogen stream 106-3 may be at a temperature, entering sub reactor 105-3, in a range of 25 to 500° C.

According to embodiments of the invention, at block 213, a mixture of mixture 110 and hydrogen stream 106-3 is subjected to reaction conditions in sub reactor 105-3 sufficient to convert hydrocarbon molecules of mixture 110 into smaller molecules (further upgrade of feed 100). According to embodiments of the invention, the further upgrading can be carried out in sub reactor 105-3 at a temperature in a range of 400 to 550° C., preferably in a range of 450 to 470° C.; at a pressure of up to 200 barg, preferably a pressure of 100 barg or less. According to embodiments of the invention, solvent is added to keep asphaltene in solution and so that conversion increases as the stage increases (e.g., from sub reactor 105-1, to sub reactor 105-2, to sub reactor 105-3). Temperature can be increased from sub reactor 105-1, to sub reactor 105-2, to sub reactor 105-3. According to embodiments of the invention, the severity of processing of feed to the reactor can be continuously increased to get higher conversion.

At block 214, according to embodiments of the invention, effluent 111 is flowed from sub reactor 105-3 to distillation column 112.

As the conversion progresses in sub reactor 105-1, then sub reactor 105-2, and then sub reactor 105-3, the tendency of asphaltenes in solution is to aggregate and precipitate out. According to embodiments of the invention, this tendency is overcome by the creation of a co-feed/solvent mixture (i.e., adding solvent 102-1, solvent 102-2, and solvent 102-3) to keep asphaltenes in solution. Without the addition of the solvent that keeps asphaltene in solution, high conversions of feed results in severe coking and serious operational issues (e.g., plugging). Another purpose is to use a solvent to loosen up/enlarge distances between asphaltene layers to prevent aggregation and also could serve as a hydrogen donor and also as an electron donor when polar solvents such as pyridine, THF are employed. It should be noted that, in embodiments of the invention, the amount of solvent (co-feed) added at each stage, namely at sub reactor 105-1, sub reactor 105-2, and sub reactor 105-3 increases. In other words, the amount of solvent 102-2 added to sub reactor 105-2 is greater than the amount of solvent 102-1 added to reactor 105-1, in embodiments. And the amount of solvent 102-3 added to sub reactor 105-3 is greater than the amount of solvent 102-2 added to sub reactor 105-2, in embodiments. In sum, according to embodiments of the invention, solvents rich in aromatics and resins are added in stages to maintain these asphaltenes in dissolved form thereby leading to their higher conversion. According to embodiments of the invention, method 20 is carried out in system 10 so that the process liquids are in asphaltene stable conditions with P value greater than 1 and more closer to 1.2. P value is defined as P=1+Xmin (Shell standards SMS 1600-01), where Critical Cetane dilution (Xmin) is the number of mL of Cetane with which 1 g of sample can be diluted until it just does not flocculate the asphaltenes.

According to embodiments of the invention, at block 215, distillation column 112 distills effluent 111 to produce product stream 115 for further upgradation, a recycle stream 114 for recycling to any of the previous sub-reactors and heavy purge stream 113 for preventing buildup of unwanted solids/coke over a period of time. Operating thermal hydroprocessing reactor 105 (collectively sub reactor 105-1, sub reactor 105-2, and sub reactor 105-3) under high severity conditions, including a temperature in a range of 400 to 550, preferably 450° C. to 470° C. and pressure up to 200 barg (typically 100 barg or less), causes product stream 115, the liquid product from this process, to have more than 97 wt. % hydrocarbons that boil below 350° C. Since method 20 is a thermal hydroprocessing process, it is expected that the products would have more olefins over other processes. Indeed, the analysis of liquid product boiling below 240° C. indicates about 8% by weight olefin content as analyzed using ASTM D6730 in a Detailed Hydrocarbon Analyzer (DHA). Also, in embodiments of the invention, as a result of thermal hydroprocessing, it is expected to have some olefins present in the gas phase and it is found that the gas has 0.65 mol. % olefins. In embodiments of the invention, steam cracker feed should preferably contain less than 1 wt. % olefins in order to minimize coking. Hence, the products from the thermal hydroprocessing (e.g., effluent 111) can be fed to a downstream deep hydrogenation unit to saturate olefins as well as opening up the ring compounds so that it can be fed to the steam cracker. Now this stream would be rich in saturated hydrocarbons and can be fed to a steam cracker to produce high value chemicals such as ethylene, propylene, butene and benzene.

According to embodiments of the invention, hydro-processing reactor 105 produces coke stream 116. In embodiments of the invention where hydro-processing reactor 105 is a fixed bed reactor, coke is burnt during regeneration. In embodiments of the invention where hydro-processing reactor 105 is an ebullated bed, there can be a coke burn step. In embodiments of the invention where hydro-processing reactor 105 is a slurry reactor or a bubble column reactor, coke can be removed by purging a small amount of bottom stream from the downstream distillation unit.

Figure 3:
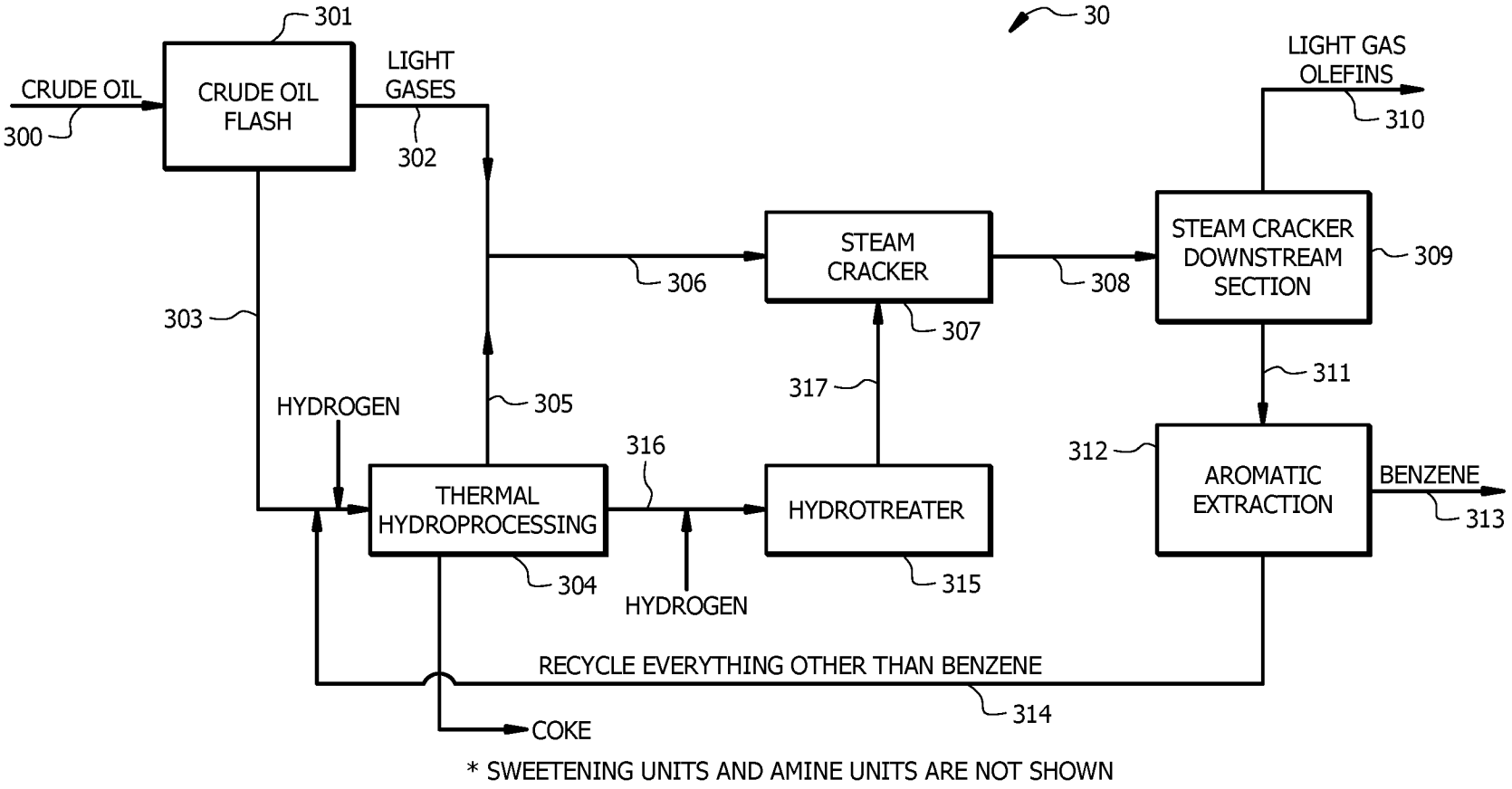
FIG. 3 is a system for thermal hydro-processing crude oil and/or heavy oil and/or residues in combination with a steam cracker unit, according to embodiments of the invention.
Figure 4:
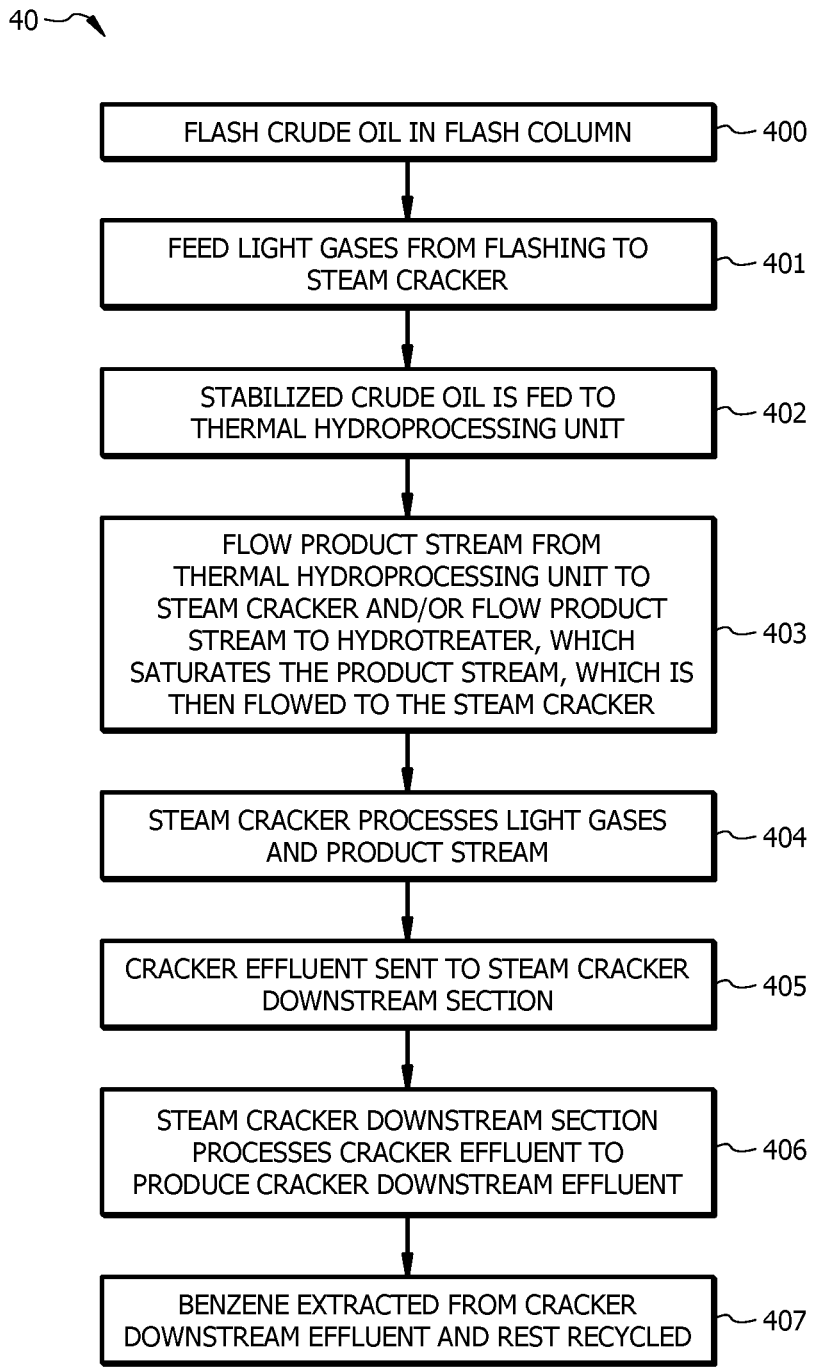
FIG. 4 is a method for thermal hydro-processing crude oil and/or heavy oil and/or residues, according to embodiments of the invention.

FIG. 3 shows system 30 for thermal hydro-processing crude oil and/or heavy oil and/or residues in combination with a hydrotreater that does deep hydrogenation and a steam cracker unit, according to embodiments of the invention. FIG. 4 shows method 40 for thermal hydro-processing crude oil and/or heavy oil and/or residues, according to embodiments of the invention. Method 40 may be implemented using system 30.

In embodiments of the invention, whole crude oil 300 is flashed, at block 400 of method 40, in flash column 301, to separate out light gases inherently present in crude oil 300. It should be noted that in embodiments of the invention the feed to flash column 301 can be heavy oil. In embodiments of the invention, light gases 302 can be fed to a dedicated gas cracker or to mixed feed cracking steam cracker. As shown in FIG. 3 and FIG. 4, in embodiments of the invention, light gases 302 is fed from flash column 301 to steam cracker 307, at block 401. According to embodiments of the invention, light gases 302 comprises 0 to 5 wt. % $C_2$, 30 to 40 wt. % $C_3$, 10 to 20 wt. % $iC_4$, and 45-55 wt. % $nC_4$.

Stabilized crude oil 303 from the bottom of flash column 301, according to embodiments of the invention, is fed to high severity thermal hydro-processing unit 304 (e.g., system 10 described above) to produce gas, liquid and coke products as described in method 20 above, at block 402. In embodiments of the invention, gas product from thermal hydro-processing unit 304 is fed to gas crackers or mixed feed cracking furnace, liquid is fed to deep hydrogenation unit and then to liquid steam cracker or mixed feed furnace and purge is used in downstream boilers/gasifiers/any other application which recovers energy value from purge or use of purge for downstream applications like electrodes, blast furnaces etc. In embodiments of the invention, purge is used to generate hydrogen and/or synthesis gas, as fuel, and/or as used as tar component in road construction applications and/or waterproofing. In embodiments of the invention, method 40 includes, at block 403, product stream 305 (e.g., product stream 115) being flowed with light gases 302 to steam cracker 307. Additionally or alternatively, in embodiments of the invention, product stream 316 (e.g., product stream 111 or a portion thereof) is flowed to hydrotreater 315, which hydrotreats product stream 316 to form saturated product stream 317 comprising primarily saturated hydrocarbons. Saturated product stream 317 is then flowed to steam cracker 307 for processing. According to embodiments of the invention, product stream 316 comprises 25 to 35 wt. % paraffins, 25 to 35 wt. % isoparaffins, 6 to 10 wt. % olefins, 12 to 15 wt. % naphthenes, and 12 to 15 wt. % aromatics. According to embodiments of the invention, saturated product stream 317 comprises 30 to 50, wt. % paraffins, 25 to 35 wt. % isoparaffins, 0 to 10 wt. % naphthenes, and 0 to 5 wt. % aromatics. At block 404, steam cracker 307 cracks light gases 302, product stream 305, and/or saturated product stream 317 to produce steam cracker effluent stream 308. According to embodiments of the invention, steam cracker 307 is operated to provide the following process reaction conditions: a temperature in a range of 800 to 860° C., a pressure in a range of 2 to 3 barg, and 0.1 to 0.5 seconds contact time. According to embodiments of the invention, steam cracker effluent stream 308 comprises 0.5 to 1.5, wt. % hydrogen, 15 to 20, wt. % methane, 35 to 45, wt. % ethylene, 15 to 20, wt. % propylene, 10 to 15 wt. % $C_4$ compounds, 0.5 wt. % pyrolysis gasoline, 0 to 0.5 wt. % fuel oil, 5 to 10 wt. % benzene, and 2.5 to 7.5 wt. % coke. At block 405, steam cracker effluent is routed to steam cracker furnace downstream section 309, where steam cracker effluent 308 is subjected to standard separation technologies known in the art and practiced industrially to produce light gas olefins 310, a paraffin gas stream (not shown in FIG. 3, but is recycled to steam cracker furnace 307), methane and hydrogen stream used as plant fuel or for producing hydrogen (also not shown in FIG. 3) and steam cracker downstream effluent 311, at block 406 to feed to aromatic extraction section 312 to separate out benzene by known commercial processes. According to embodiments of the invention, steam cracker 307 is operated at the following conditions: a temperature in a range of 800 to 860° C., a pressure in a range of 2 to 3 barg, and a contact time of 0.1 to 0.5 seconds. According to embodiments of the invention, light gas olefins 310 comprises 50 to 65 wt. % ethylene, 25 to 30 wt. % propylene, and 15 to 20 wt. % butene. In embodiments of the invention, steam cracker downstream effluent 311 is flowed to aromatic extraction unit 312, which extracts benzene 313 to leave recycle stream 314, at block 407. According to embodiments of the invention, recycle stream 314 comprises 45 to 55 wt. % pygas oil and 45 to 55 wt. % fuel oil.

In order to avoid fuel oil or pyrolysis gasoline in products coming out of steam cracker 307, recycle stream 314 is recycled to extinction by feeding it back to thermal hydro-processing unit 304 after extracting higher value benzene. The recycling of recycle stream 314 after extracting benzene to thermal hydro-processing unit 304 is advantageous as this stream is rich in aromatics and will help in keeping asphaltenes in soluble condition during conversion in thermal hydro-processing unit 304 and reduce fouling in that unit/minimize coke.

Method 40 can result in ethylene yields in excess of 30 wt. % and the yield of high value chemicals from crude oil (i.e., ethylene, benzene, propylene and butenes/butadienes) can be in excess of 70 wt. %. Further, in embodiments of the invention, the ethylene/propylene yield ratio by mass is above 1.2, preferentially above 1.5 and more preferentially above 2. The methane produced in the process can be used to generate hydrogen. Further, the methane and hydrogen produced in the process can be used as fuel in steam cracking furnace/thermal hydro-processing preheat furnace or for energy value in the utility section in an oil-to-chemicals complex. Also, it is possible to recover hydrogen from the cracked gas products from the steam cracker by feeding a separated mixture of methane and hydrogen through a PSA/membrane unit or any such hydrogen recovery unit. The recovered hydrogen can be used internally in thermal hydro-processing unit 304 while methane gas separated can be used for its energy content in furnaces, produce additional hydrogen utilizing a hydrogen generation unit (Steam Methane Reformer), or used in conversion units like oxidative coupling of methane (OCM) units to produce additional high value ethylene.

Although embodiments of the present invention have been described with reference to blocks of FIG. 2 and FIG. 4, it should be appreciated that operation of the present invention is not limited to the particular blocks and/or the particular order of the blocks illustrated in FIG. 2 and FIG. 4. Accordingly, embodiments of the invention may provide functionality as described herein using various blocks in a sequence different than that of FIG. 2 and FIG. 4.

EXAMPLES

Example 1

Demonstration of the Effect of Thermal Hydroprocessing of Crude Oil

As part of the disclosure of the present invention, specific examples are included below. The examples are for illustrative purposes only and are not intended to limit the invention. Those of ordinary skill in the art will readily recognize parameters that can be changed or modified to yield essentially the same results.

A West Texas blend crude oil residue with a boiling point distribution ranging from 120° C. to 705° C. was used in this study. The composition of the feed in the boiling range of 120° C. to 240° C. contained 25.047 wt. % paraffin, 22.343 wt. % isoparaffin, 0.287 wt. % olefin, 11.727 wt. % naphthene, 16.938 wt. % aromatics, 0.385 wt. % heavies and 23.275 wt. % other unknown hydrocarbon types. The feed had a density of 0.85 g/cc at 30° C. The boiling point distribution of this stream is shown below in Table 1.

TABLE 1

| Boiling Point Distribution of Feed Stream Crude 120+° C. Stream | |
|---|---|
| Mass % | Boiling Point, ° C. |
| IBP | 84.4 |
| 5 | 139.8 |
| 10 | 162.8 |
| 15 | 183.2 |
| 20 | 204.2 |
| 25 | 222.4 |
| 30 | 240.2 |
| 35 | 258.8 |
| 40 | 278 |
| 45 | 298 |
| 50 | 315.4 |
| 55 | 338.4 |
| 60 | 362 |
| 65 | 390.6 |
| 70 | 424.6 |
| 75 | 466.4 |
| 80 | 499 |
| 85 | 526.8 |
| 90 | 560.2 |
| 95 | 611.2 |
| 99 | 687.4 |
| 100 | 705.6 |

The reactor used in the study was a fixed bed reactor located inside a 3-zone split-tube furnace. The reactor's internal diameter was 13 mm with a concentrically located thermowell of 3.17 mm outer diameter. The reactor was 91.3 cm in length. The reactor was filled with neutral alumina for heat transfer to the 120+° C. boiling cut residue from West Texas blend crude oil used as feed. The reactor was maintained at operating conditions with a weight hourly space velocity (WHSV) of 1 $hr^{-1}$ (oil flow rate of 20.4 g/hr i.e., 0.4 ml/min), a $H_2$/HC ratio of 400 NL/L of liquid feed ($H_2$ gas with a flow rate of 9.4 NL/h), a pressure of 40.8 barg (600 psig) and reactor inerts bed temperature of 450° C. The reactor effluent gases (e.g., a hydrocarbon product) were cooled to condense the liquids (i.e., treated hydrocarbon stream in the form of a liquid product) under pressure while allowing non-condensed gases (e.g., methane, ethane, or combinations thereof) to separate as a gas product and flow to a wet gas meter. The effluent gas flow was analyzed using a refinery gas analyzer Gas Chromatograph (a custom gas analyzer from M/s AC Analytical Controls BV). The liquid product obtained from the packed bed reactor was analyzed by a Simulated Distillation (SIMDIS) gas chromatograph for boiling point distribution as shown in Table 2. SIMDIS results indicated the entire product boiled below 350° C. starting from a feed having an end boiling point above 700° C. The liquid was further analyzed by a Detailed Hydrocarbon Analyzer (ASTM D6730) and had a PIONA composition of the product boiling below 240° C. as shown in Table 3 with olefins in the liquid product at approximately 7.8 wt. % concentration. This indicates that the olefins in the product need to be saturated before feeding to steam cracker in a hydrotreater that does deep hydrogenation. However, it is also possible to change reactor severity as well as the olefin concentration in liquid product by increasing hydrogen partial pressure either through higher reactor pressure or employing higher $H_2$/hydrocarbon ratio. Exploiting these process handles, olefins in liquid products might be brought to <1 wt. %, which would make the downstream hydrotreater optional.

TABLE 2

| Boiling Point Distribution of Feed and Liquid Product | | |
|---|---|---|
| Mass % | West Texas Crude oil 120+° C. cut used as feed Boiling Point (BP), ° C. | Liquid Product BP, ° C. |
| IBP | 84.4 | 36 |
| 5 | 139.8 | 84.4 |
| 10 | 162.8 | 102 |
| 15 | 183.2 | 122.4 |
| 20 | 204.2 | 128.4 |
| 25 | 222.4 | 139.8 |
| 30 | 240.2 | 152.4 |
| 35 | 258.8 | 162.8 |
| 40 | 278 | 175 |
| 45 | 298 | 185.2 |
| 50 | 315.4 | 197.2 |
| 55 | 338.4 | 207 |
| 60 | 362 | 217.4 |
| 65 | 390.6 | 227.2 |
| 70 | 424.6 | 236.8 |
| 75 | 466.4 | 249.4 |
| 80 | 499 | 260 |
| 85 | 526.8 | 272.2 |
| 90 | 560.2 | 287.2 |
| 95 | 611.2 | 302.2 |
| 99 | 687.4 | 323.6 |
| 100 | 705.6 | 329.8 |

TABLE 3

| Detailed Hydrocarbon Analysis of Liquid Product and Feed With BP Below 240° C. | | | | | | | | |
|---|---|---|---|---|---|---|---|---|
| S. No. | Sample | P | I | O | N | A | Heavies | Unknowns |
| 1 | Feed | 25.047 | 22.343 | 0.287 | 11.727 | 16.938 | 0.385 | 23.275 |
| 2 | Liquid Product | 26.55 | 24.515 | 7.793 | 13.92 | 13.114 | 0.026 | 14.082 |

For example, starting with 100 g of feed containing 22.9 g of PIONA compounds boiling below 240° C., the liquid product generated had 58.5 g of PIONA compounds boiling below 240° C. can be quantified as below in TABLE 4.

TABLE 4

| Groups | <240° C. Boiling Material in Feed | <240° C. Boiling Material as Liquid Product |
|---|---|---|
| Paraffin, g | 7.5 | 18.1 |
| Isoparaffin, g | 6.7 | 16.7 |
| Olefins, g | 0.1 | 5.3 |
| Naphthenes, g | 3.5 | 9.5 |
| Aromatics, g | 5.1 | 8.9 |
| Sum → | 22.9 | 58.5 |

Raw reactor effluent gases contain hydrogen and the analysis of this gas indicates 0.65 mol. % of olefins in the gas products as shown in Table. 5.

TABLE 5

| Gas Analysis | |
|---|---|
| Gas Components | Mole % |
| $C_1$, mol. % | 9.1 |
| $C_2$-$C_4$ Saturates, mol. % | 4.26 |
| $C_2$-$C_4$ olefins, mol. % | 0.65 |

On hydrogen-free basis, the mol. % of the gas components indicate methane concentrations of 65.2 wt. % and $C_2$-$C_4$ olefins at 4.6 wt. % as shown in Table 6.

TABLE 6

| Gas Analysis | |
|---|---|
| Gas Components | Mole % |
| $C_1$, mol. % | 65.2 |
| $C_2$-$C_4$ Saturates, mol. % | 30.2 |
| $C_2$-$C_4$ olefins, mol. % | 4.6 |

This can be separated in a steam cracker separation train to give a $C_2$-$C_4$ olefins product, methane for use as fuel/feed to oxidative coupling of methane/any other purpose and $C_2$-$C_4$ saturates product for use as steam cracker feed.

TABLE 7

| Boiling Point Distribution Liquid Product Obtained in Example 4 | |
|---|---|
| Mass % | BP |
| 0 | 71.4 |
| 5 | 105 |
| 10 | 141.2 |
| 15 | 165 |
| 20 | 179.4 |
| 25 | 195.4 |
| 30 | 211.6 |
| 35 | 222.4 |
| 40 | 234 |
| 45 | 249.4 |
| 50 | 263 |
| 55 | 278 |
| 60 | 286.8 |
| 65 | 288.6 |
| 70 | 289.8 |
| 75 | 291 |
| 80 | 292 |
| 85 | 301 |
| 90 | 315.6 |
| 95 | 339.2 |
| 99 | 370 |
| 100 | 386 |

TABLE 8

| Detailed Hydrocarbon Analysis of Feed and Liquid Product with BP Below 240° C. | | | | | | | | |
|---|---|---|---|---|---|---|---|---|
| S. No. | Sample | P | I | O | N | A | Heavies | Unknowns |
| 1 | Feed | 25.047 | 22.343 | 0.287 | 11.727 | 16.938 | 0.385 | 23.275 |
| 2 | Liquid Product | 32.375 | 9.384 | 8.314 | 4.761 | 13.91 | 12.034 | 19.219 |

Example 2

Effect of Using an Inert Like Silicon Carbide with Higher Thermal Conductivity The experiment was carried out similar to the method described in Example 1 except that the inert alumina was replaced with silicon carbide that had a higher thermal conductivity compared to alumina. The liquid product obtained from the reaction was analyzed by a Simulated Distillation (SIMDIS) gas chromatograph for boiling point distribution as shown in Table 7. More than 96.5% of material boils below 350° C. whereas the entire 100% material is boiling below 350° C. from the product obtained in Example 1. This again may be attributed to the higher heat retaining capacity of alumina as compared to silicon carbide. Residual acidity data, if any in neutral alumina used will be shared to justify the contribution of residual acidity. The observed effect in reality would be a combined contribution of residual acidity, thermal conductivity and process conditions.

Example 3

Effect of Thermal Hydroprocessing Concept in Association with a Steam Cracker This example is constructed to demonstrate the beneficial effect of the thermal hydroprocessing concept in association with a steam cracker to produce high yields of high value chemicals, namely ethylene, propylene, benzene, and butenes. FIG. 3 is a representation of a combination of a flash tower with a thermal hydroproces sing unit, a downstream hydrotreater unit to saturate liquid olefins, and steam cracker unit. The feed crude oil is flashed in a crude flash tower where the objective is to remove only $H_2$, $H_2S$, and $C_1$-$C_4$ hydrocarbons from the liquid feed, after caustic scrubbing/any other means for removal of $H_2S$ is fed to gas crackers or mixed feed furnaces to maximize conversion to ethylene. The stabilized crude oil from the bottom of the flash tower is fed to the thermal hydroproces sing unit to produce a liquid product more than 97 wt. % of which boils below 350° C. Gas product from this unit feeds the gas cracker as above and liquid products feed liquid steam cracker or a mixed feed furnace after saturating olefins in the feed in a hydrotreater. Fuel oil and pyrolysis gasoline produced in the steam cracking process is subjected to benzene extraction and the balance material is recycled back to the thermal hydroprocessing unit to extinction. This recycling not only helps in maximizing the desired products but also helps in increasing the aromatic content in the thermal hydroprocessing unit which will help in keeping asphaltenes in solution. Mass balances indicated in Table 9 indicate that a typical yield of approximately 38 wt. % ethylene, 18 wt. % propylene, 12 wt. % butenes and 7.5 wt. % benzene can be realized. This takes the yield of these high value chemicals to approximately 77 wt. % of whole crude oil. The benefit of this process is that the ethylene to propylene ratio is approximately 2.1 which is very high for producing chemicals to crude oils. The loss of coke in the process is approximately 5-6 wt. % which is typical of fuel and loss numbers in refineries. The yield of $H_2$ at 1 wt. % can be separated from the product gases to partly meet the hydrogen demand in the thermal hydroprocessing unit while the balance requirement can be met by a hydrogen generation unit. Methane produced in the process can be used to meet the furnace heating requirements in the process, or any spare methane available can be used in hydrogen generation units or can be used as a feed in downstream oxidative coupling of methane (OCM) or other gas conversion units to produce additional chemicals for ethylene production or for making syngas. Coke can be utilized as a fuel for generating steam, heat or can be used to produce syngas, for other applications.

TABLE 9

Typical Mass Balance for a Flowsheet for a Combination of Steam Cracker with Thermal Hydroprocessing Unit Final Yields of the flowsheet

| Products | MTD | Wt % of product |
|---|---|---|
| H2 | 617.7 | 1.03 |
| Methane | 10408.8 | 17.30 |
| Ethylene | 23332.0 | 38.78 |
| Propylene | 11202.1 | 18.62 |
| C4 | 7255.0 | 12.06 |
| Py Gas | 0.2 | 0.00 |
| Fuel Oil | 0.2 | 0.00 |
| Benzene | 4603.1 | 7.65 |
| Coke (MTD) | 2746.0 | 4.56 |
| Total Products ---> | 60165.0 | |

| Feed | MTD |
|---|---|
| H2 Consumption | 3051.6 |
| Feed crude oil | 57114.0 |
| Total Feed ---> | 60165.6 |

In the context of the present invention, at least the following 20 embodiments are described. Embodiment 1 is a method of processing hydrocarbons. The method includes subjecting a mixture containing (1) a feedstock of crude oil and/or heavy oil and/or residues, (2) water and/or steam, (3) hydrogen, (4) a solvent selective for dissolving asphaltene, in a processing unit, to conditions sufficient to convert at least some hydrocarbon molecules of the feedstock to molecules that have less carbon atoms than the at least some hydrocarbon molecules. The method further includes recovering, from the processing unit, intermediate product streams containing: (1) a gas stream that comprises primarily $C_1$ to $C_4$ hydrocarbons, (2) a liquid stream that comprises primarily saturates, and cracking the liquid stream to produce one or more of ethylene, propylene, butene, and benzene. Embodiment 2 is the method of embodiment 1, wherein the processing unit includes a reactor unit and a separation unit and the method further includes, prior to the subjecting step, flowing (1) the feedstock of crude oil and/or heavy oil and/or residues, (2) the water and/or steam, (3) the hydrogen, and (4) the solvent selective for dissolving asphaltene, to the reactor unit, wherein the subjecting step is carried out in the reactor unit. The method also includes flowing effluent from the reactor unit to the separation unit, wherein the separation unit contains a distillation column. The method further includes distilling the effluent from the reactor unit, in the distillation column, to produce: (1) the gas stream and (2) the liquid stream. Embodiment 3 is the method of embodiment 2, wherein the reactor unit contains a plurality of reactors and the subjecting step includes subjecting a mixture containing the feedstock of crude oil and/or heavy oil, the water and/or steam, a first portion of the hydrogen, and a first portion of the solvent in a first reactor of the plurality or reactors, to reaction conditions sufficient to convert at least some hydrocarbon molecules of the feedstock to molecules that have less carbon atoms than the at least some hydrocarbon molecules of the feedstock. The method also includes flowing first reactor effluent from the first reactor to a second reactor of the plurality of reactors. The method further includes subjecting the first reactor effluent, a second portion of the hydrogen and a second portion of the solvent, in the second reactor of the plurality of reactors, to reaction conditions sufficient to convert at least some hydrocarbon molecules of the first reactor effluent to molecules that have less carbon atoms than the at least some hydrocarbon molecules of the first reactor effluent. Embodiment 4 is the method of embodiment 3, wherein the reactor unit contains two reactors and a second reactor effluent is the effluent from the reactor unit. Embodiment 5 is the method of embodiment 3, further including flowing a second reactor effluent from the second reactor to a third reactor of the plurality of reactors, and subjecting the second reactor effluent, a third portion of the hydrogen, and a third portion of the solvent, in the third reactor of the plurality of reactors, to reaction conditions sufficient to convert at least some hydrocarbon molecules of the second reactor effluent to molecules that have less carbon atoms than the at least some hydrocarbon molecules of the second reactor effluent. Embodiment 6 is the method of embodiment 5, wherein the reactor unit contains three reactors and a third reactor effluent is the effluent from the reactor unit. Embodiment 7 is the method of any of embodiments 1 to 6, wherein the hydrogen is provided by a hydrogen rich stream containing fuel gas, cracked gases, and $H_2$ from steam methane reforming. Embodiment 8 is the method of any of embodiments 2 to 7, wherein the hydrogen is maintained at a pressure of up to 100 barg and more preferentially up to 70 barg in the reactor unit. Embodiment 9 is the method of any of embodiments 1 to 8, wherein the solvent contains primarily aromatics, resins, and less than 0.1 wt. % benzene. Embodiment 10 is the method of any of embodiments 1 to 9, wherein asphaltenes are stable, having P value greater than 1. Embodiment 11 is the method of any of embodiments 1 to 10, wherein the method does not include the use of a catalyst. Embodiment 12 is the method of any of embodiments 2 to 11, wherein water and/or steam is supplied to the processing unit at a flow rate required for the supply of the hydrogen to be at least 0.2 wt. % of the feedstock. Embodiment 13 is the method of any of embodiments 1 to 12, wherein the ethylene/propylene yield ratio by mass is above 1.2, preferentially above 1.5 and more preferentially above 2 and ethylene yield is above 35 wt. %. Embodiment 14 is the method of any of embodiments 1 to 13, wherein the cracking further produces methane. Embodiment 15 is the method of embodiment 14, wherein the methane is used to generate hydrogen. Embodiment 16 is the method of embodiment 14, wherein the methane produced is coupled to produce ethylene. Embodiment 17 is the method of any of embodiments 1 to 15, further including hydrotreating the liquid stream before the cracking step. Embodiment 18 is the method of any of embodiments 1 to 16, wherein the feedstock of crude oil and/or heavy oil and/or residues is flashed to remove material with a boiling point less than 35° C. prior to the subjecting step. Embodiment 19 is the method of any of embodiments 2 to 16, wherein hydrogen is recovered from a steam cracker used in the cracking step and the recovered hydrogen is used in the reactor unit. Embodiment 20 is the method of any of embodiments 1 to 19, wherein the solvent is provided in the mixture in a quantity sufficient to keep at least 90 wt. % of asphaltenes from the feedstock in solution.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method of processing hydrocarbons, the method comprising:

subjecting a mixture comprising: (1) a feedstock of crude oil and/or heavy oil and/or residues, (2) water and/or steam, (3) hydrogen, (4) a solvent selective for dissolving asphaltene, in a processing unit, to conditions sufficient to convert at least some hydrocarbon molecules of the feedstock to molecules that have less carbon atoms than the at least some hydrocarbon molecules;

recovering, from the processing unit, intermediate product streams comprising: (1) a gas stream that comprises primarily $C_1$ to $C_4$ hydrocarbons, (2) a liquid stream that comprises primarily saturates; and cracking the liquid stream to produce one or more of ethylene, propylene, butene, and benzene.

2. The method of claim 1, wherein the processing unit comprises a reactor unit and a separation unit and the method further comprises:

prior to the subjecting step, flowing (1) the feedstock of crude oil and/or heavy oil and/or residues, (2) the water and/or steam, (3) the hydrogen, and (4) the solvent selective for dissolving asphaltene, to the reactor unit, wherein the subjecting step is carried out in the reactor unit;

flowing effluent from the reactor unit to the separation unit, wherein the separation unit comprises a distillation column;

distilling the effluent from the reactor unit, in the distillation column, to produce: (1) the gas stream and (2) the liquid stream.

3. The method of claim 2, wherein the reactor unit comprises a plurality of reactors and the subjecting step comprises:

subjecting a mixture comprising the feedstock of crude oil and/or heavy oil, the water and/or steam, a first portion of the hydrogen, and a first portion of the solvent in a first reactor of the plurality or reactors, to reaction conditions sufficient to convert at least some hydrocarbon molecules of the feedstock to molecules that have less carbon atoms than the at least some hydrocarbon molecules of the feedstock;

flowing first reactor effluent from the first reactor to a second reactor of the plurality of reactors;

subjecting the first reactor effluent, a second portion of the hydrogen and a second portion of the solvent, in the second reactor of the plurality of reactors, to reaction conditions sufficient to convert at least some hydrocarbon molecules of the first reactor effluent to molecules that have less carbon atoms than the at least some hydrocarbon molecules of the first reactor effluent.

4. The method of claim 3, wherein the reactor unit comprises two reactors and a second reactor effluent is the effluent from the reactor unit.

5. The method of claim 3, further comprising:

flowing a second reactor effluent from the second reactor to a third reactor of the plurality of reactors:

subjecting the second reactor effluent, a third portion of the hydrogen, and a third portion of the solvent, in the third reactor of the plurality of reactors, to reaction conditions sufficient to convert at least some hydrocarbon molecules of the second reactor effluent to molecules that have less carbon atoms than the at least some hydrocarbon molecules of the second reactor effluent.

6. The method of claim 5, wherein the reactor unit comprises three reactors and a third reactor effluent is the effluent from the reactor unit.

7. The method of claim 1, wherein the hydrogen is provided by a hydrogen rich stream comprising a member selected from the group consisting of fuel gas, cracked gases and $H_2$ from steam methane reforming.

8. The method of claim 2, wherein the hydrogen is maintained at a pressure of up to 100 barg in the reactor unit.

9. The method of claim 1, wherein the solvent comprises primarily aromatics, resins, and less than 0.1 wt. % benzene.

10. The method of claim 1, wherein asphaltenes have P value greater than 1.

11. The method of claim 1, wherein the method does not include the use of a catalyst.

12. The method of claim 2, wherein water and/or steam is supplied to the processing unit at a flow rate required for the supply of the hydrogen to be at least 0.2 wt. % of the feedstock.

13. The method of claim 1, wherein the ethylene/propylene yield ratio by mass is above 1.2 and ethylene yield is above 35 wt. %.

14. The method of claim 1, wherein the cracking further produces methane.

15. The method of claim 14, wherein the methane is used to generate hydrogen.

16. The method of claim 14, wherein the methane produced is coupled to produce ethylene.

17. The method of claim 1, further comprising hydrotreating the liquid stream before the cracking step.

18. The method of claim 1, wherein the feedstock of crude oil and/or heavy oil and/or residues is flashed to remove material with a boiling point less than 35° C. prior to the subjecting step.

19. The method of claim 2, wherein hydrogen is recovered from a steam cracker used in the cracking step and the recovered hydrogen is used in the reactor unit.

20. The method of claim 1, wherein the solvent is provided in the mixture in a quantity sufficient to keep at least 90 wt. % of asphaltenes from the feedstock in solution.

* * * * *